US006322742B1

(12) United States Patent
Bott

(10) Patent No.: US 6,322,742 B1
(45) **Date of Patent: *Nov. 27, 2001**

(54) METHOD OF PRODUCING STACKABLE CONCRETE BLOCKS

(75) Inventor: Tim Allen Bott, Sunfish Lake, MN (US)

(73) Assignee: Allan Block Corporation, Edina, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/110,784

(22) Filed: Jul. 6, 1998

(51) Int. Cl.[7] ..... B28B 5/02; B28B 1/44; B28B 11/14; B28B 7/28; B28B 7/24

(52) U.S. Cl. ..... 264/297.9; 264/71; 264/157; 264/333; 425/253; 425/414; 425/452; 425/468; 249/52; 405/286

(58) Field of Search ..... 425/414, 468, 425/356, 452, 253; 249/52; 264/333, 71, 163, 157, 297.9; 405/286

(56) References Cited

U.S. PATENT DOCUMENTS 3,679,340 * 7/1972 Springs ..... 264/71
3,833,331 * 9/1974 Springs ..... 264/71
3,955,907 * 5/1976 Yamasita et al. ..... 264/157
4,098,865 * 7/1978 Repasky ..... 264/333
4,335,549 * 6/1982 Dean, Jr. ..... 52/98
4,886,633 * 12/1989 Rook et al. ..... 264/219
4,920,712 * 5/1990 Dean, Jr. ..... 52/169.4
5,017,049 * 5/1991 Sievert ..... 405/284
5,082,438 * 1/1992 Rook et al. ..... 425/358
5,484,236 * 1/1996 Gravier ..... 405/286
5,589,124 * 12/1996 Woolford et al. ..... 264/333
5,598,679 * 2/1997 Orton et al. ..... 52/609
5,795,105 * 8/1998 Guth ..... 405/284
6,142,713 * 11/2000 Woolford et al. ..... 405/286

FOREIGN PATENT DOCUMENTS 0 649 714 A1 * 4/1995 (EP) ..... B28B/7/02

* cited by examiner

*Primary Examiner*—Jan H. Silbaugh
*Assistant Examiner*—Michael I. Poe
(74) *Attorney, Agent, or Firm*—Haugen Law Firm PLLP

(57) ABSTRACT

A method of preparing stackable block structures from raw concrete mixes and block structures prepared in accordance with the method, wherein the process utilizes a mold box configured to form the block on its side surface. The mold box is arranged to travel along the surface of a moving conveyor belt, with the box having an open top, an open bottom, and lateral side panels supported on the conveyor belt surface, and with the panels having core bar receiving openings formed therein. The core bars are introduced and removed from the mold box along an axis which is parallel to the surface of the core bars and to the motion axis of the conveyor belt, and with the core bars configuring one of the two opposed side surfaces of the stackable block. A reciprocating top shoe arranged for reciprocatory up and down motion engages and configures the top surface of the raw concrete mix held within the walls of the mold box.

5 Claims, 3 Drawing Sheets

METHOD OF PRODUCING STACKABLE CONCRETE BLOCKS

BACKGROUND OF THE INVENTION

The present invention relates generally to a method of preparing stackable block structures from raw concrete mixes, and more particularly to such a method for forming block structures wherein the individual blocks are formed in a mold box with the sides of the block being positioned along the upper and lower surfaces of the mold box. More particularly, the method of the present invention relates to such an assembly process wherein articulated core bars are introduced and removed from the mold box along an axis formed parallel to the bottom surface of the mold box and parallel to the surface of the conveyor upon which the blocks are formed. Stackable blocks prepared in accordance with the present invention are processed expeditiously and find wide application in the creation and erection of retaining walls, as well as for general building purposes.

In the past, concrete blocks and stackable block structures in particular have typically been formed from raw concrete mixes compressed and formed or otherwise configured within a mold box. These mold boxes have frequently been supported or otherwise positioned on the surface of a moving conveyor wherein various operations are undertaken in the process of formation and creation of the blocks. In order to fabricate stackable block structures with a configuration including a hollow core, core rods have been utilized which are typically articulated along an axis perpendicular or normal to the surface of the supporting conveyor belt, and with the supporting surface of the conveyor belt in direct contact with the surface of the block which becomes the top or the bottom. Such processes are relatively straightforward when conventional blocks are being formed, however when blocks having winged or flanged protrusions along one of their surfaces, these typical processes and/or procedures become difficult to undertake on a continuous and/or automatic basis. The present invention utilizes a process and technique which departs from the typical operations described above, and at the same time, makes it possible to continuously and/or automatically produce blocks which are formed with wing portions and/or flanges along the rear face thereof.

SUMMARY OF THE INVENTION

In accordance with the present invention, the stackable block structures are formed utilizing a mold box in which the individual block structures are fabricated on their sides. In other words, the supporting surface of the conveyor belt makes contact with the first of the two opposed side surfaces of the blocks being formed thereon, thereby making it possible for core rods to be articulated along axes which are parallel to the surface of the conveyor belt, and also to the direction of belt travel. Additionally, blocks may be made in mold boxes on a two-up basis, with the orientation of the blocks being such that handling or positioning of the blocks during the unloading process will dispose or position the blocks in a position ready for splitting and/or cleaving along the mid-section to form a pair of substantially identical block elements. When fabricated in this fashion, a more rapid and/or continuous production operation is facilitated, and with post-cure handling and processing of the blocks being substantially expedited. In the actual steps or operations of the process, core rods are introduced horizontally along and through the base of the mold box, and a raw concrete mix of predetermined composition and consistency is introduced into the mold box. Thereafter, with the amount of concrete mix being appropriately metered, a reciprocatory block-configuring shoe is pressed downwardly onto the upper surface of the raw concrete mix in order to configure what ultimately becomes the second of the two opposed side surfaces or walls of the block.

In accordance with the technique of the present invention, block structures may be expeditiously formed continuously on a moving conveyor, and wherein the blocks are formed on their side surfaces, and wherein the finished blocks have a modified trapezoidal configuration tapering from front to rear and with laterally extending flanged wings defining a generally rectangular rear face. Such blocks have been found to have a configuration highly desirable for the fabrication of mortar-free structures, such as retaining walls, with the winged configuration being particularly useful in facilitating the formation of arcuate or curved walls. These walls are made possible by striking or breaking away the laterally extending flanged wing or wings of adjacent blocks to form a block with a fully trapezoidal configuration in plan view thus giving rise to ease of creation of desired orientation of individual blocks forming the retaining wall.

Therefore, it is a primary object of the present invention to provide an improved method of preparing stackable block structures from raw concrete mixes wherein the mold boxes are arranged so that the blocks being formed are positioned on their side surfaces, thereby making it possible to fabricate a block with a modified trapezoidal and winged configuration which tapers from front to rear while having laterally extending flanged wings forming the rear face or surface of the block.

It is yet a further object of the present invention to provide an improved method of preparing stackable block structures from raw concrete mixes wherein the block structures formed have a configuration which is trapezoidal tapering from front to rear, along with laterally extending flanged wings defining a generally rectangular rear face.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
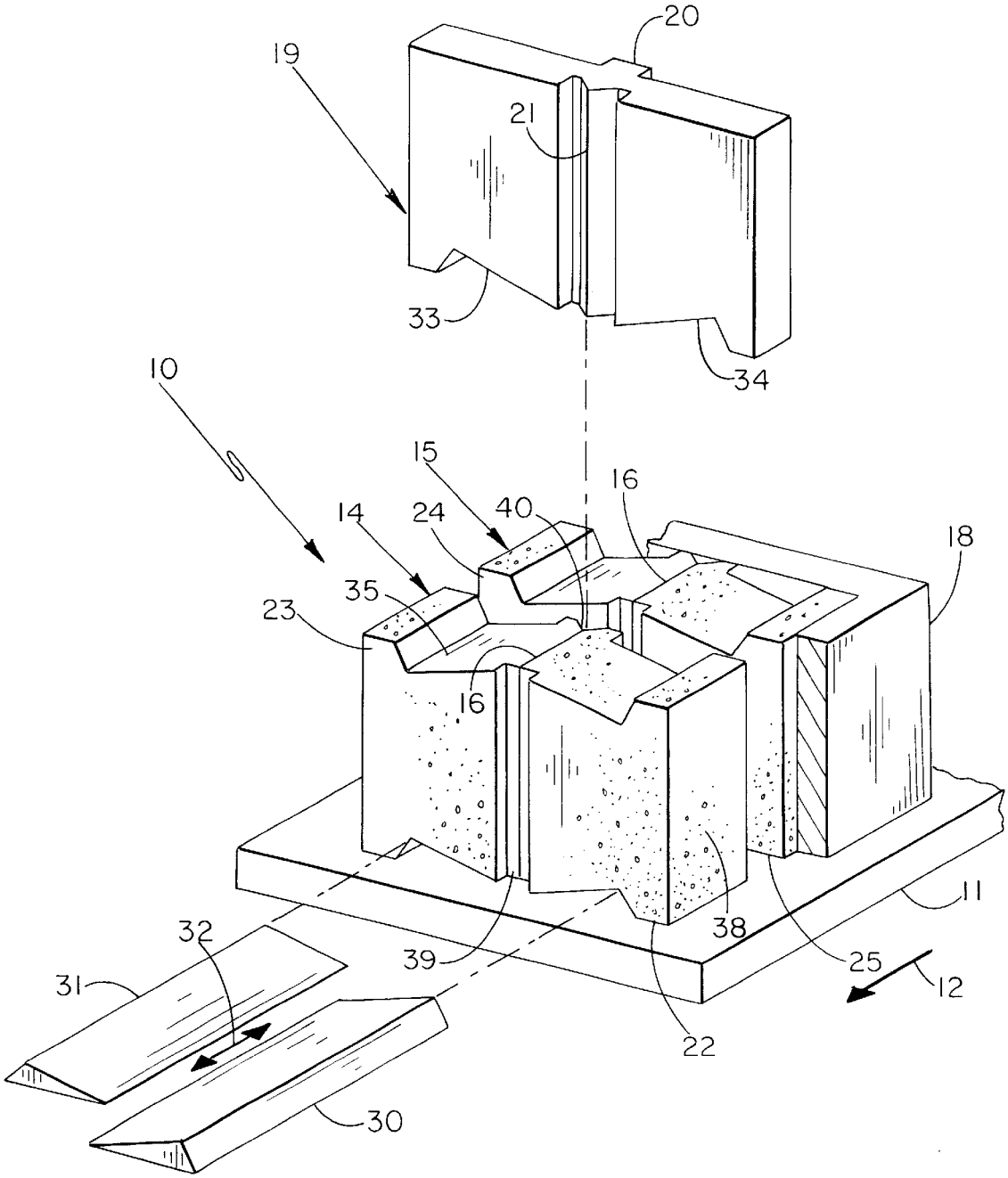
FIG. 1 is a perspective view of a portion of a support or surface being used to support a mold box arranged to produce stackable concrete blocks in accordance with the present invention, with certain of the components utilized in the process being shown in exploded disposition, and with portions of the mold box being cut-away.

In accordance with the preferred modification of the present invention, and with particular attention to FIG. 1 of the drawings, the block forming process of the present invention is preferably undertaken in the system assembly generally designated 10 which includes a continuous conveyor, with a portion or segment of the belt being shown at 11, and with axis of travel of the belt being shown at 12. Disposed and/or positioned on the upper surface of the belt 11 are a pair of dual blocks as at 14 and 15, with these blocks being formed and arranged to be cleaved along the lines as at 16—16. These individual blocks are configured to provide for splitting and/or cleaving along the plane extending through the dual block assemblies 14 and 15 along line 16—16. The blocks are formed in a mold box, a portion of which is illustrated at 18, with the box containing four vertically positioned walls along with a central divider plate 19 which, during the forming operation, is positioned medially between blocks 14 and 15, as indicated. Plate 19 has a projection for forming the offset notch in the blocks as at 20, along with a portion as at 21 to provide the lip. Additionally, the arrangement is such that wing or flange surfaces are provided in the blocks 14 and 15 as at 22, 23, 24 and 25.

Figure 2:
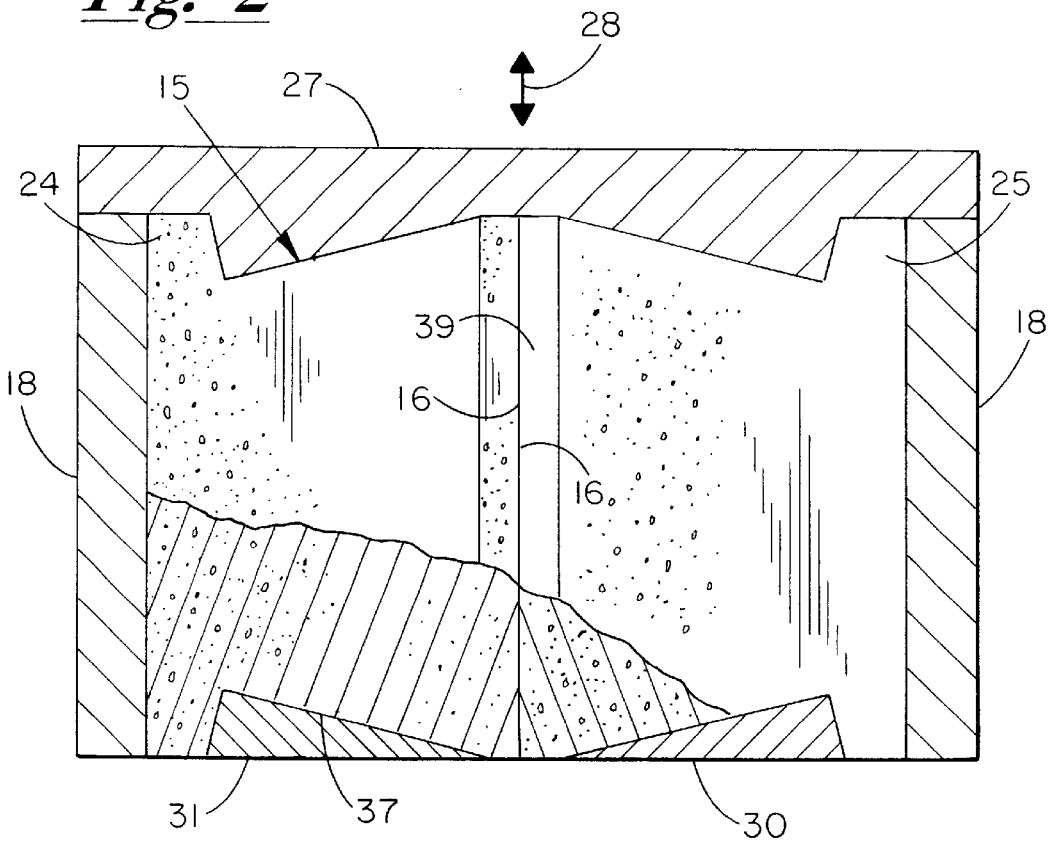
FIG. 2 is a side elevational view, partly in section, illustrating the configuration of the top surface of a block in contact with the stomper or shoe utilized to form and/or configure the top surface in the mold box, and with a portion of the shoe being shown in section.

With reference to FIG. 2 of the drawings, a section of the shoe or stomper for forming the top surface is shown at 27, with the shoe being articulated reciprocably along the line and in the direction of double-headed arrow 28.

With continued attention being directed to FIG. 1 of the drawings, horizontally positioned core rods or puller blades are illustrated at 30 and 31, with these rods being arranged for reciprocating to-and-fro motion along the line and in the direction of the arrow 32. In this arrangement, therefore, core rods 30 and 31 are positioned along the bottom surface of the mold box cavity, and are arranged to form the modified trapezoidal configuration of the blocks 14 and 15. As indicated in FIG. 1, portions of plate 19 are relieved as at 33 and 34 to accommodate and receive core rods 30 and 31 during the actual block preparation operation, with core rods 30 and 31 being of triangular cross-sectional configuration.

Means are provided for delivering raw concrete mix to the mold box, with the concrete, as delivered, being indicated generally at 35. Raw concrete delivery systems are, of course, in common use in the block industry and are well known to those of ordinary skill.

In a typical operation, therefore, the mold box such as box 18 is positioned on the surface of a conveyor belt such as at 11. Core rods 30 and 31 are introduced along an axis parallel to the surface of the conveyor and to the axis of motion of the conveyor, with the core rods 30 and 31 extending through relieved zones 33 and 34 and through similar relieved zones formed in the base of mold box 18. Thereafter, an appropriate metered charge of raw concrete is introduced into the mold box 18, with the mold box at that time being provided with its conventional open top. As indicated in FIG. 1, mold box 18 will typically be provided with lateral side panels to form the remaining portions of the box, and will further be provided with core bar receiving openings such as illustrated at 37 in FIG. 2. The reciprocating top shoe, shown at 27 in FIG. 2 is then pressed downwardly upon the charge of concrete mix in order to engage the surface of the mix and configure the top surface. The mold box 18 together with the shoe 27 is held in place with the block for the time period necessary to permit the charge to set up and become self-sustaining. Once the raw concrete has cured to an appropriate extent, the top shoe along with the core rods are removed and the blocks cured further, if required, prior to cleaving. For assisting in the articulation motion of the individual blocks 14 and 15, the blocks, formed on a two-up basis, are arranged in the same orientation to assist in the rotational motion necessary prior to the cleaving operation.

It will be noted that the individual block structures formed are of a modified trapezoidal configuration tapering from front to rear, and with laterally extending flanged wings 22, 23, 24 and 25 inclusive. The flanged wings define a generally rectangular rear face shown generally at 38, for example. As indicated hereinabove, the winged configuration has been found desirable for those applications where a departure from a straight-line wall is desired.

As indicated in FIG. 1 of the drawings, the individual dual block assemblies as at 14 and 15 are provided with a rectangular recess as at 39 and a "V"-notch as at 40. It is this configuration which permits the individual blocks to be stacked in a desired vertical alignment and/or set-back, with both the "V"-notch and the rectangular recess being arranged in opposed relationship on the upper and lower surfaces respectively of the finished block structure. As indicated in FIG. 1, both the "V"-notch and the rectangular recess are positioned medially of the ends of the dual block blank and in opposed relationship, one to another.

Figure 3:
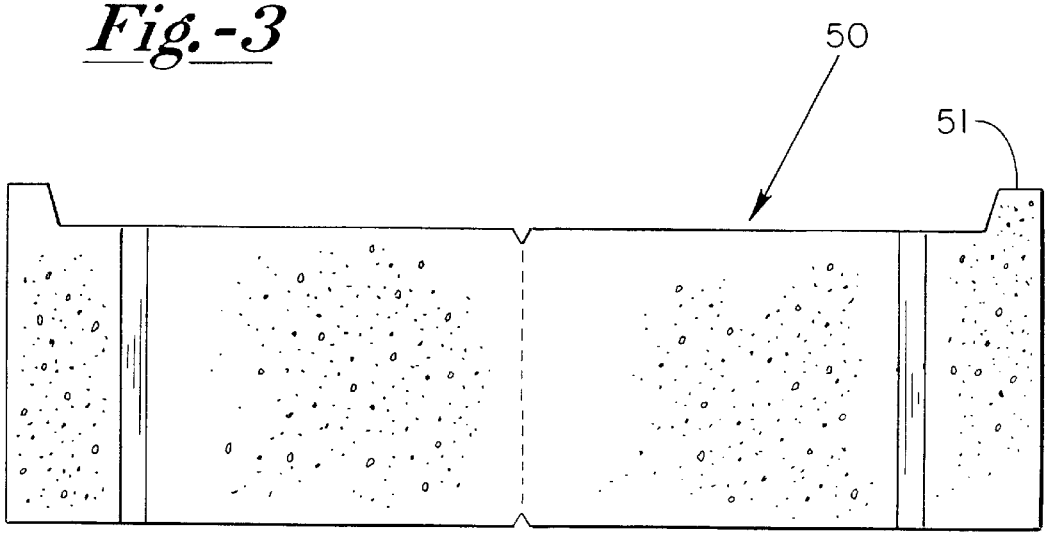
FIG. 3 is a side elevational view of a dual block structure illustrating an asymmetrical form of single wing or lip along the rear or back surface of each block in the dual block structure illustrated.
Figure 4:
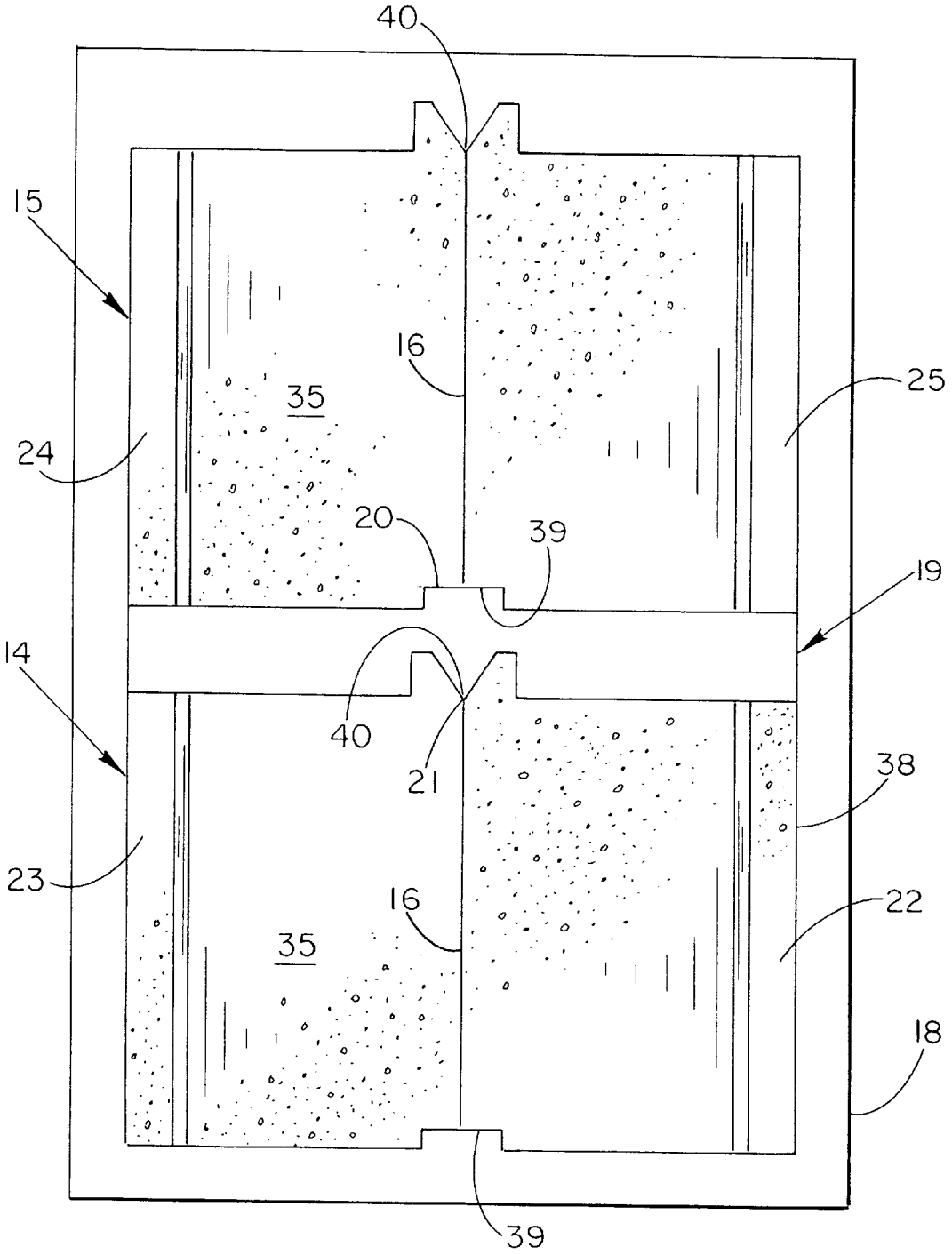
FIG. 4 is a top plan view of a mold box with a central divider plate positioned therein.

In addition to the block configuration illustrated herein, a modified form of block incorporating a symmetrical wing design may also be fabricated. In a modified form, it is possible to conveniently fabricate a block with a lip along the rear or back surface of the finished block in order to provide an additional alternative design. Such a structure is illustrated in FIG. 3 of the drawings, with the block structure generally designated 50 incorporating a rear lip as at 51. The remaining features of the block are essentially the same as those illustrated in FIG. 1.

The drawings presented herein have illustrated a pair of two-up block structures, however, it will be appreciated that multiple arrangements are equally possible with the apparatus disclosed herein, along with the steps in the processes disclosed herein. For example, multiple groups totaling from four to sixty-four blocks or more are possible and feasible with the apparatus and steps disclosed herein. Those skilled in the art can appreciate the manner of implementing and exercising such apparatus and steps.

It will be appreciated that the features of the present invention as set forth herein are given for purposes of illustration, and departures may be made from this description without departing from the spirit and scope of the present invention.

What is claimed is:

1. The method of preparing stackable block structures from raw concrete mixes with the block structures having top, opposed bottom and side surfaces, said method utilizing a movable planar base support, a mold box with an open top and bottom, opposed longitudinal side panels and opposed lateral side panels with core bar receiving openings formed therein, and a reciprocating top shoe for reciprocatory up and down motion to engage the raw concrete mix so as to configure the top surface of said block structures within said mold box, and means to charge said mold box with raw concrete mix materials, said method being characterized in that:

(a) said movable planar base support is a conveyor belt arranged to travel along a generally horizontal axis of motion and to support said mold box and core bars;

(b) said charging means infusing said raw concrete mix materials in said mold box;

(c) said core bars being reciprocably introduced and removed from said charged mold box through said core bar receiving openings and along an axis disposed parallel to the surface of said core bar and parallel to longitudinal surfaces of said core bars and parallel to and coincidentally with said conveyor belt motion axis and arranged to configure one of said two opposed side surfaces of said stackable block structure;

(d) said top shoe being reciprocably introduced and removed from said charged mold box along a vertical axis perpendicular to said core bars axis of motion, and configuring the opposed side surface of said stackable block structure; and (e) the lateral side panels of said mold box being configured to form the top and bottom surfaces of a dual stackable block blank, with said dual stackable block blank being cleavable along its mid-section to form a pair of substantially identical stackable block structures.

2. The method as defined in claim 1 being particularly characterized in that the opposed side surfaces of said dual stackable block blank include a generally medially positioned V-notch on one of said side surfaces and a rectangle on the opposed side surface, with said V-notch and said rectangle being positioned medially of the ends of said dual stackable block blank and in opposed relationship, one to another.

3. The method as defined in claim 1 being particularly characterized in that said mold box includes a divider plate disposed medially within said box and along an axis perpendicular to said opposed longitudinal side panels and spanning said opposed lateral side panels to form a pair of cavities, each configured to form one of said pair of identical stackable block structures.

4. The method as defined in claim 1 being particularly characterized in that said stackable block structures are of a modified trapezoid configuration tapering from front to rear and with laterally extending flanged wings defining a generally rectangular rear face.

5. The method as defined in claim 4 being particularly characterized in that said core bars have a generally triangular cross-sectional configuration to create block structures having a modified trapezoidal configuration, and wherein respective motion of said top shoe and said core bars is synchronized and occurs substantially simultaneously.

* * * * *